US007494207B2

(12) United States Patent
Huang et al.

(10) Patent No.: US 7,494,207 B2
(45) Date of Patent: Feb. 24, 2009

(54) FLUID INJECTION DEVICE PREVENTING ACTIVATION OF A BIPOLAR JUNCTION TRANSISTOR (BJT) THEREIN

(75) Inventors: Tsung-Wei Huang, Taipei (TW); Chung-Cheng Chou, Taoyuan County (TW)

(73) Assignee: Qisda Corporation, Taoyuan Country (TW)

( * ) Notice: Subject to any disclaimer, the term of this patent is extended or adjusted under 35 U.S.C. 154(b) by 442 days.

(21) Appl. No.: 11/331,514

(22) Filed: Jan. 13, 2006

(65) Prior Publication Data

US 2006/0152552 A1 Jul. 13, 2006

(30) Foreign Application Priority Data

Jan. 13, 2005 (TW) ..... 94100991 A

(51) Int. Cl.
*B41J 2/05* (2006.01)

(52) U.S. Cl. ..... 347/56; 347/57

(58) Field of Classification Search ..... 347/20, 347/56–59, 50, 61–65, 67
See application file for complete search history.

(56) References Cited

U.S. PATENT DOCUMENTS 5,635,968 A * 6/1997 Bhaskar et al. ..... 347/59
6,471,338 B2 10/2002 Chen et al. ..... 347/59
6,841,830 B2 * 1/2005 Liu et al. ..... 257/368

* cited by examiner

*Primary Examiner*—Juanita D Stephens

(57) ABSTRACT

Fluid injection devices comprise M sets of fluid injection units. Each fluid injection unit comprises N injectors separately connecting to a driver. A controller separately transmits a signal to the driver, thereby simultaneously driving a selected injector of each of the M sets of fluid injection units. A non-selected injector of each of the M sets of fluid injection units does not trigger bipolar junction transistors (BJTs).

17 Claims, 11 Drawing Sheets

| | 1P | 2P | 3P | 4P | 5P | 6P | 7P | 8P | 9P | 10P | 11P | 12P | 13P | 14P | 15P | 16P |
|---|---|---|---|---|---|---|---|---|---|---|---|---|---|---|---|---|
| $\Delta V_d$(V) | 0.6 | 0.6 | 0.64 | 0.68 | 0.72 | 0.72 | 0.72 | 0.72 | 0.72 | 0.76 | 0.76 | 0.76 | 0.76 | 0.8 | 0.8 | 0.84 |
| Id(mA) | 47 | 47 | 47 | 49 | 50 | 55 | 60 | 64 | 74 | 78 | 86 | 94 | 105 | 105 | 119 | 137 |
| Time(ns) | 105 | 105 | 105 | 110 | 112 | 115 | 120 | 150 | 180 | 200 | 220 | 265 | 305 | 355 | 385 | 415 |
| Q($10^{-12}$) | 4935 | 4935 | 4935 | 5390 | 5600 | 6325 | 7200 | 9600 | 13320 | 15600 | 18920 | 24910 | 32025 | 37275 | 35815 | 56855 |
| $C_{JD}$($10^{-14}$F/$\mu m^2$) | 0.426 | 0.426 | 0.425 | 0.462 | 0.479 | 0.541 | 0.616 | 0.821 | 1.139 | 1.330 | 1.466 | 1.770 | 2.100 | 2.263 | 2.596 | 3.010 |

FIG. 9

| | 1P | 2P | 3P | 4P | 5P | 6P | 7P | 8P | 9P | 10P | 11P | 12P | 13P | 14P | 15P | 16P |
|---|---|---|---|---|---|---|---|---|---|---|---|---|---|---|---|---|
| $\Delta V_d$(V) | 0.56 | 0.56 | 0.56 | 0.64 | 0.68 | 0.68 | 0.7 | 0.72 | 0.72 | 0.72 | 0.76 | 0.76 | 0.84 | 0.88 | 0.96 | 0.96 |
| Id(mA) | 46 | 46 | 46 | 46 | 48 | 49 | 52 | 54 | 64 | 72 | 78 | 88 | 100 | 102 | 113 | 136 |
| Time(ns) | 92 | 92 | 92 | 92 | 92 | 95 | 100 | 110 | 152 | 172 | 197 | 232 | 265 | 310 | 340 | 362 |
| Q($10^{-12}$) | 4232 | 4232 | 4232 | 4232 | 4416 | 4655 | 5200 | 5940 | 9728 | 12384 | 15366 | 20416 | 26500 | 31620 | 38420 | 49232 |
| $C_{JD}$($10^{-14}$F/$\mu m^2$) | 0.366 | 0.366 | 0.366 | 0.364 | 0.379 | 0.399 | 0.445 | 0.508 | 0.832 | 1.059 | 1.191 | 1.450 | 1.727 | 1.907 | 2.150 | 2.582 |

FIG. 10

| | 1P | 2P | 3P | 4P | 5P | 6P | 7P | 8P | 9P | 10P | 11P | 12P | 13P | 14P | 15P | 16P |
|---|---|---|---|---|---|---|---|---|---|---|---|---|---|---|---|---|
| $\Delta V_d$(V) | 0.6 | 0.6 | 0.6 | 0.68 | 0.76 | 0.76 | 0.76 | 0.76 | 0.76 | 0.76 | 0.76 | 0.8 | 0.84 | 0.88 | 0.96 | 0.96 |
| Id(mA) | 47 | 47 | 47 | 49 | 56 | 59 | 64 | 75 | 88 | 100 | 105 | 121 | 133 | 143 | 167 | 190 |
| Time(ns) | 95 | 95 | 95 | 95 | 102 | 102 | 117 | 155 | 180 | 217 | 270 | 310 | 350 | 377 | 417 | 447 |
| Q($10^{-12}$) | 4465 | 4465 | 4465 | 4655 | 5712 | 6018 | 7488 | 11625 | 15840 | 21700 | 28350 | 37510 | 46550 | 53911 | 69639 | 84930 |
| $C_{JD}$($10^{-14}$F/$\mu m^2$) | 0.385 | 0.385 | 0.385 | 0.399 | 0.487 | 0.513 | 0.638 | 0.991 | 1.350 | 1.850 | 2.197 | 2.656 | 3.033 | 3.252 | 3.896 | 4.455 |

FIG. 11

FLUID INJECTION DEVICE PREVENTING ACTIVATION OF A BIPOLAR JUNCTION TRANSISTOR (BJT) THEREIN

BACKGROUND

The invention relates to fluid injection devices, and more particularly, to fluid injection devices preventing activation of a bipolar junction transistor (BJT) therein.

Typically, fluid injection devices are employed in inkjet printers, fuel injectors, biomedical chips and other devices. Among inkjet printers presently known and used, injection by thermally driven bubbles has been most successful due to reliability, simplicity and relatively low cost.

FIG. 1 is a cross section of a conventional monolithic fluid injector disclosed in U.S. Pat. No. 6,471,338, the entirety of which is hereby incorporated by reference. A conventional monolithic fluid injector 10 is fabricated by micro-electro-mechanical system (MEMS) and metal oxide semiconductor field effect transistor (MOSFET) processes. The conventional monolithic fluid injector comprises a base such as a silicon substrate 38 with a field oxide layer 50 thereon. A structural layer 42 is formed on the field oxide layer 50. A fluid chamber 14 is formed between the silicon substrate 38, the field oxide 50, and the structural layer 42. The fluid chamber 14 connects a fluid reservoir (not shown) via a channel 16. A first heater 20 and a second heater 22 are formed on the structural layer 42. A dielectric layer 45 is disposed overlying the structural layer 42 defining a nozzle 17. The nozzle 17 adjacent to the first and the second heaters 20, 22 connects the fluid chamber 14. The first and the second heaters 20 electrically connect a driver via a signal transmitting circuit 44. The driver is a MOSFET comprising a drain 107, a gate 105 with a gate dielectric layer 52 between the 105 and the base 38, and a source 106, wherein the drain 107 electrically connects the signal transmitting circuit 44. A passivation 46 is disposed on the fluid injection device and the driver.

As the development of fabrication processes has progressed, fluid injection devices with high density nozzles and multiple activation methods thereof to increase printing quality and speed have been introduced. A driver integrated with conventional fluid injection devices comprises a MOSFET device. When multiple nozzles are activated simultaneously, parasitic bipolar junction transistors (BJT) can be triggered, causing abnormal injection. The abnormal injection not only reduces printing quality, but also overheats the heaters, reducing the lifetime of the fluid injection device.

Accordingly, fluid injection devices with high density nozzles and multiple activation methods which do not activate parasitic bipolar junction transistors (BJTs) are desirable.

SUMMARY

The invention provides fluid injector devices integrating MOSFET doping with low concentration dopant to reduce junction capacitance between a drain and a base, preventing activation of parasitic bipolar junction transistors (BJTs) and abnormal injection.

The invention further provides a fluid injection device, comprising M sets of fluid injection units, each fluid injection unit comprising N injectors, each injector separately connecting to a driver, and a controller separately transmitting a signal to the driver, thereby simultaneously driving a selected injector of each of the M sets of fluid injection units, wherein a non-selected injector of each of the M sets of fluid injection units does not trigger a bipolar junction transistor (BJT).

Note that the injector comprises a structural layer disposed on a substrate, a fluid chamber formed between the substrate and the structural layer, a channel connecting the fluid chamber, at least one fluid actuator disposed on the structural layer and opposing the fluid chamber, and a nozzle adjacent to the at least one fluid actuator passing through the structural layer connecting the fluid chamber.

The invention also provides a fluid injection device, comprising M sets of fluid injection units, each fluid injection unit comprising N injectors, each injector separately connecting a MOS transistor comprising a drain, a gate, a source, and a base, wherein the drain connects the injector via a signal transmitting circuit, and wherein the junction capacitance between the drain and the base is equal to or less than $1.139\times 10^{-14}(F/\mu m^2)$, and a controller separately transmitting a signal to the driver, thereby simultaneously driving the injector of each of the M sets of fluid injection units, wherein the injector is driven by the driver without triggering a bipolar junction transistor (BJT).

DESCRIPTION OF THE DRAWINGS

The invention can be more fully understood by reading the subsequent detailed description in conjunction with the examples and references made to the accompanying drawings, wherein:

FIG. 9 shows the relationship of depletion capacitance of drain junction $C_{JD}$ and the number of driving loads under a dosage concentration of $10^{20}$ atoms/cm$^3$;

FIG. 10 shows the relationship of depletion capacitance of drain junction $C_{JD}$ and the number of driving loads under increasing 20% dosage concentration of $10^{20}$ atoms/cm$^3$; and FIG. 11 shows the relationship of depletion capacitance of drain junction $C_{JD}$ and the number of driving loads under reducing 20% dosage concentration of $10^{20}$ atoms/cm$^3$.

DETAILED DESCRIPTION

Reference will now be made in detail to the preferred embodiments of the invention, examples of which are illustrated in the accompanying drawings.

Figure 1:
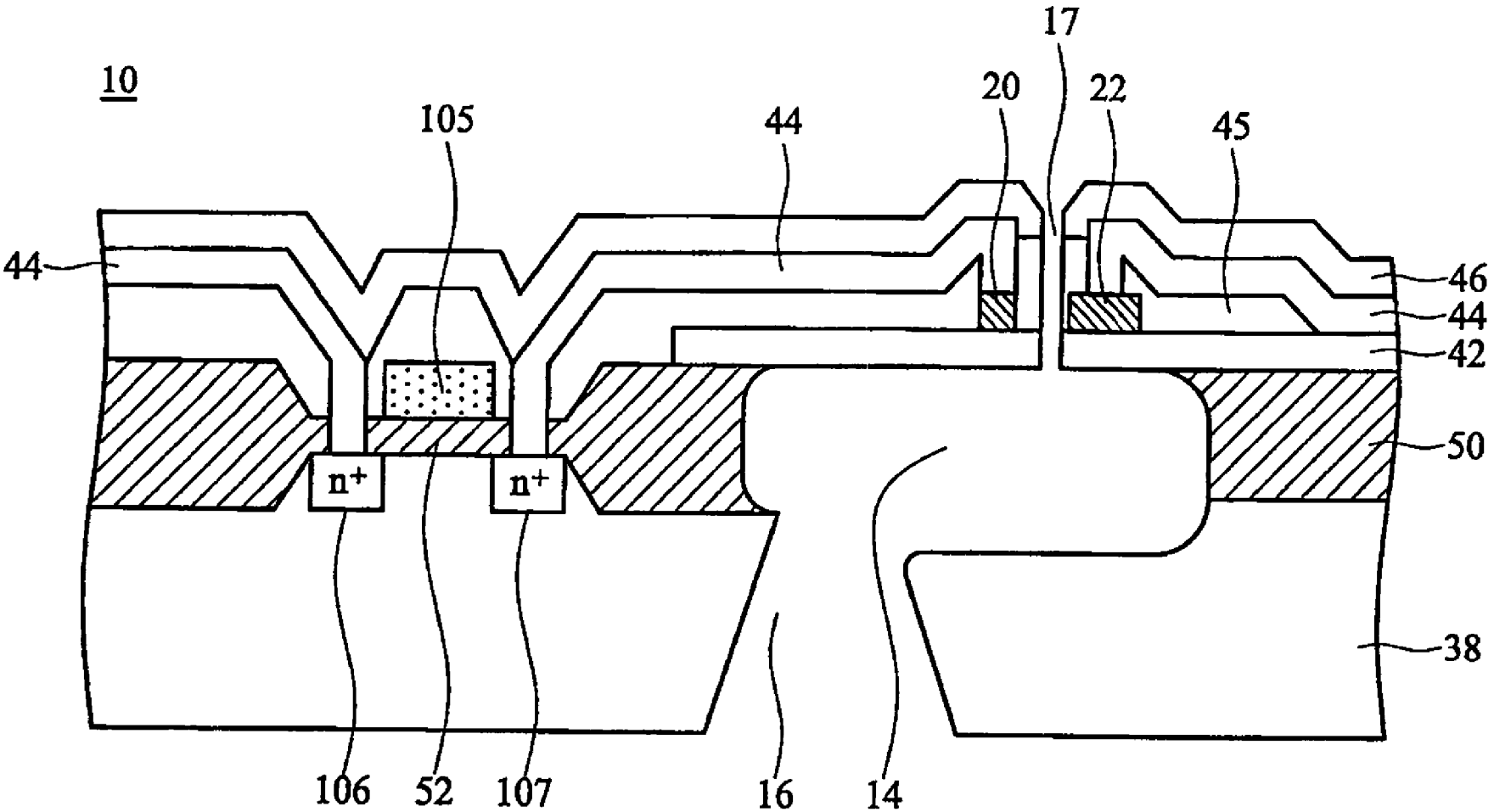
FIG. 1 (RELATED ART)
FIG. 1 is a cross section of a conventional monolithic fluid injector.
Figure 2:
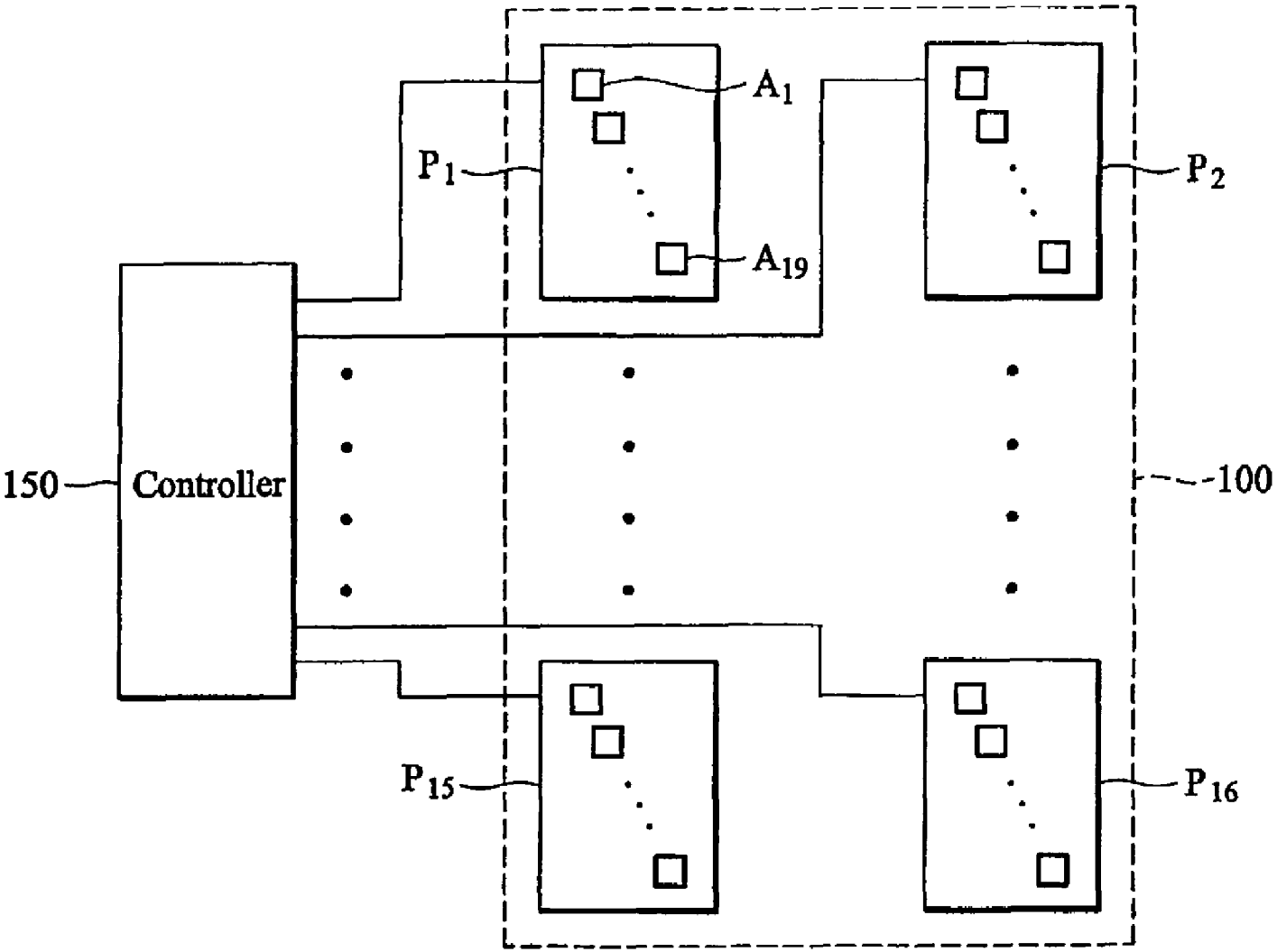
FIG. 2 is a block diagram of an embodiment of a fluid injection device according to an embodiment of the invention.

FIG. 2 is a block diagram of an embodiment of a fluid injection device according to an embodiment of the invention. Note that the invention provides a monolithic fluid injection device with 300 nozzles for implementing different features of various embodiments. These are, of course, merely examples and are not intended to be limiting. It should be appreciated by those skilled in the art that other injection devices, such as high density piezoelectric injector, can also use the transistor disclosed hereinafter.

The fluid injection device 100 comprises M sets such as 16 sets of injection units $P_1$-$P_{16}$. Each set of injection units $P_1$-$P_{16}$ comprises N number of such as 19 nozzles $A_1$-$A_{19}$. Each nozzle $A_1$-$A_{19}$ connects to a driver (not shown). A controller 150 transmits a control signal to each driver separately, thereby one nozzle $A_1$-$A_{19}$ in each set of injection units $P_1$-$P_{16}$ can be triggered simultaneously. The un-selected nozzles $A_1$-$A_{19}$ are not triggered by parasitic bipolar junction transistor (BJT) of the corresponding driver.

Figure 3:
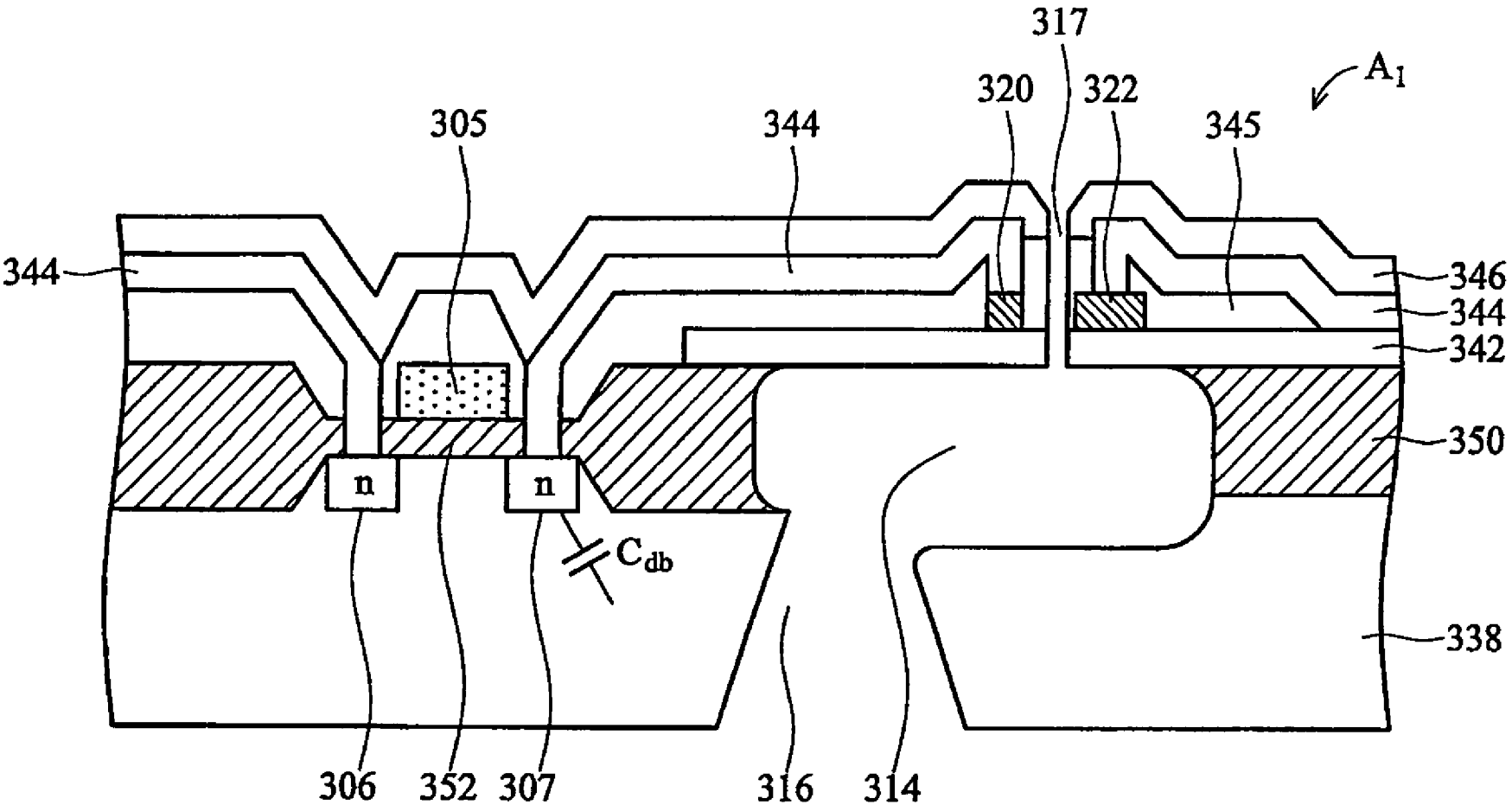
FIG. 3 is a cross section of a nozzle of a fluid injection device according to an embodiment of the invention.

FIG. 3 is a cross section of an exemplary embodiment of nozzle $A_1$ of the fluid injection device 100. The nozzle $A_1$ is fabricated using standard micro-electro-mechanical system (MEMS) and metal-oxide-semiconductor (MOS) transistor processes. A base such as a silicon substrate 338, with field oxide 350 thereon is provided. A structural layer 342 is disposed on the silicon substrate 338 and the field oxide 350. A fluid chamber 314 is formed in the field oxide 350 between the substrate 338 and the structural layer 342 for receiving fluid. The fluid chamber 314 connects a fluid container (not shown) through a fluid channel 316. A dielectric layer 345 is disposed overlying the structural layer 342 defining a nozzle 317. The nozzle 317 is formed between heaters 320, and 322, communicating with the fluid chamber 314. A first heater 320 and a second heater 322 are disposed on the structural layer 342. The first heater 320 and second heater 322 can be electrically coupled to a driver. The driver can be a metal-oxide-semiconductor field effect transistor (MOSFET) comprising a drain 307, a gate 305 with a gate dielectric layer 352 between the 305 and the base 338, a source 306, for example. The drain 307 can electrically connect to a signal transmitting circuit 344. The junction capacitance between the drain and the substrate can be reduced by reducing the doping concentration of the source 306 and drain 307, thereby preventing an unselected nozzle from being triggered by the parasitic bipolar junction transistor (BJT). Thus, optimized printing results can be achieved. For example, the n-type doping concentration of the source 306 and the drain 307 is preferably in a range of $10^{20}$-$10^{21}$ atoms/cm$^3$ with corresponding junction capacitance between the drain and the substrate of less than or equal to $1.139\times10^{-14}$ F/μm$^2$. A passivation layer 346 covers the fluid injection device 100 and driver.

Figure 4:
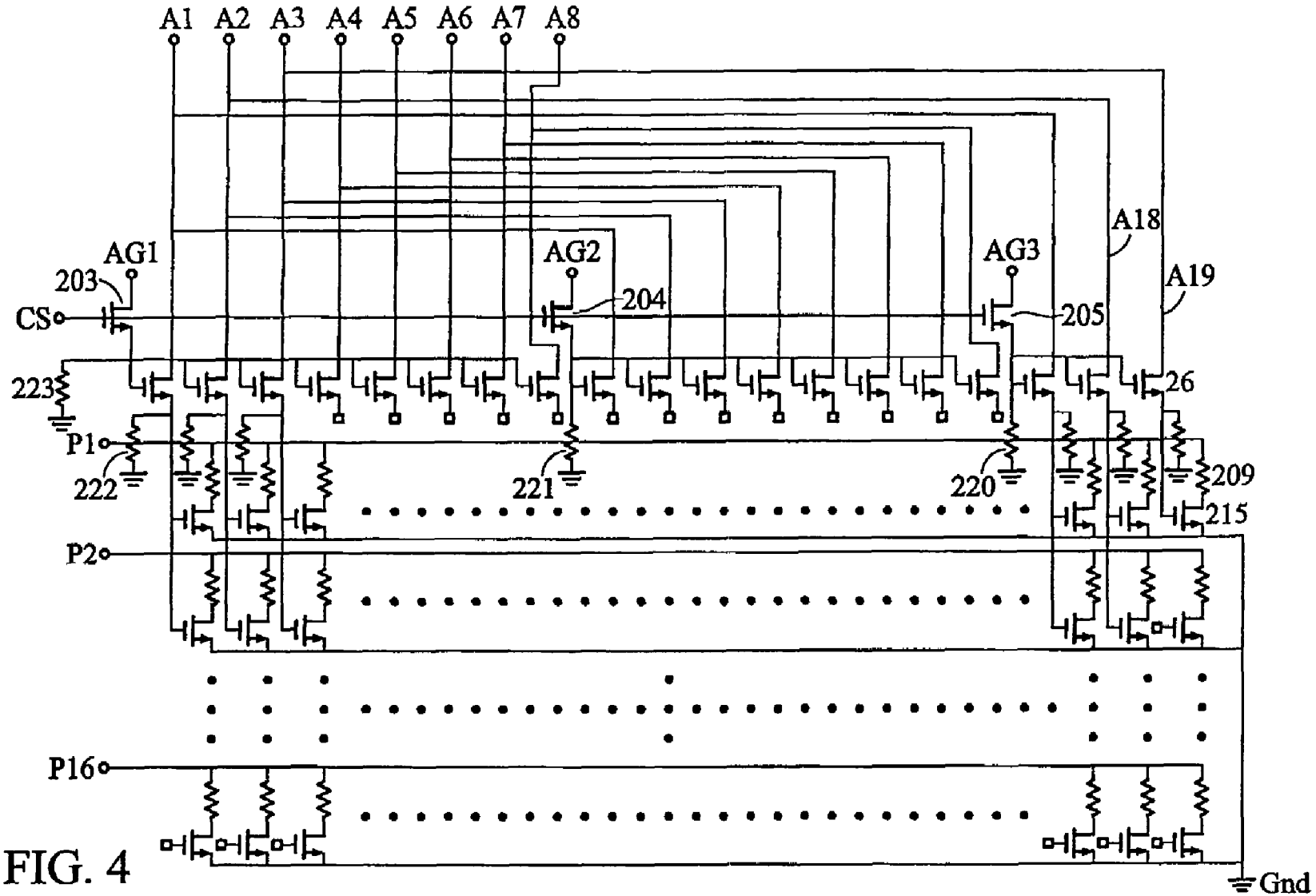
FIG. 4 is a schematic view of an exemplary embodiment of the active matrix driving circuit.
Figure 5:
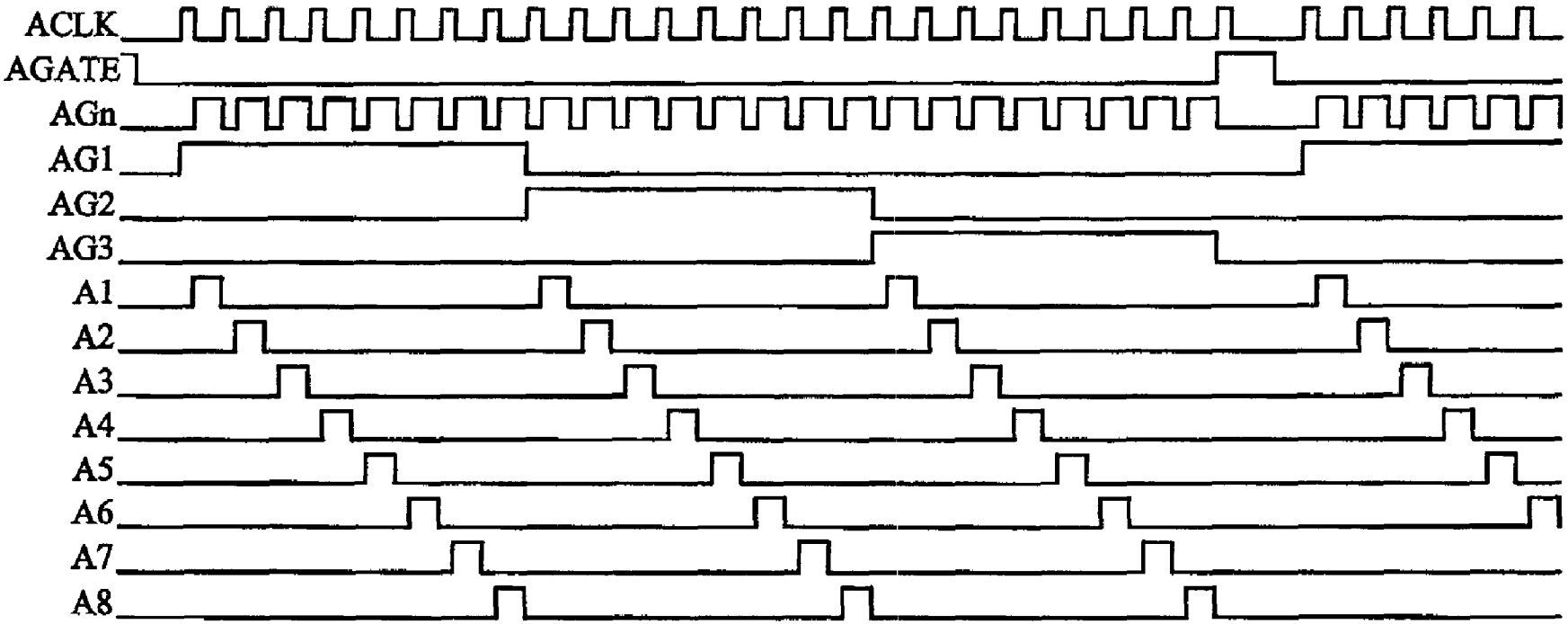
FIG. 5 shows driving signals of the active matrix driving circuit to activate the fluid injection device.

FIG. 4 is a schematic view of an exemplary embodiment of the active matrix driving circuit. According to some embodiments of the invention, the fluid injection device 100 can be divided into 16 groups ($P_1$-$P_{16}$), for example. Each group can be divided into 19 addresses ($A_1$-$A_{19}$). In order to reduce the total number of the I/O pads on the tape automatic bond (TAB) board, the addresses $A_1$-$A_{19}$ can be further grouped into three pads (AG1, AG2, AG3). FIG. 5 shows driving signals of the active matrix driving circuit which activate the fluid injection device.

Referring to FIG. 4, when a specific nozzle is selected, a selected address ($A_1$-$A_{19}$) and group ($P_1$-$P_{16}$) are switched on. If a fluid injection device is selected, controller 150 applies bias on pad CS to turn on switches 203, 204 and 205. Next, pads AG1, AG2, AG3 can be sequentially biased to turn on switches of the addresses ($A_1$-$A_{19}$). For example, a selected nozzle $A_{19}$, i.e., pad $A_{19}$ of group AG3 is triggered by turning on the MOSFET 215. A current P1 can pass through the MOSFET 215 to heaters neighboring the nozzle $A_{19}$, thereby activating the nozzle $A_{19}$.

Figure 6:
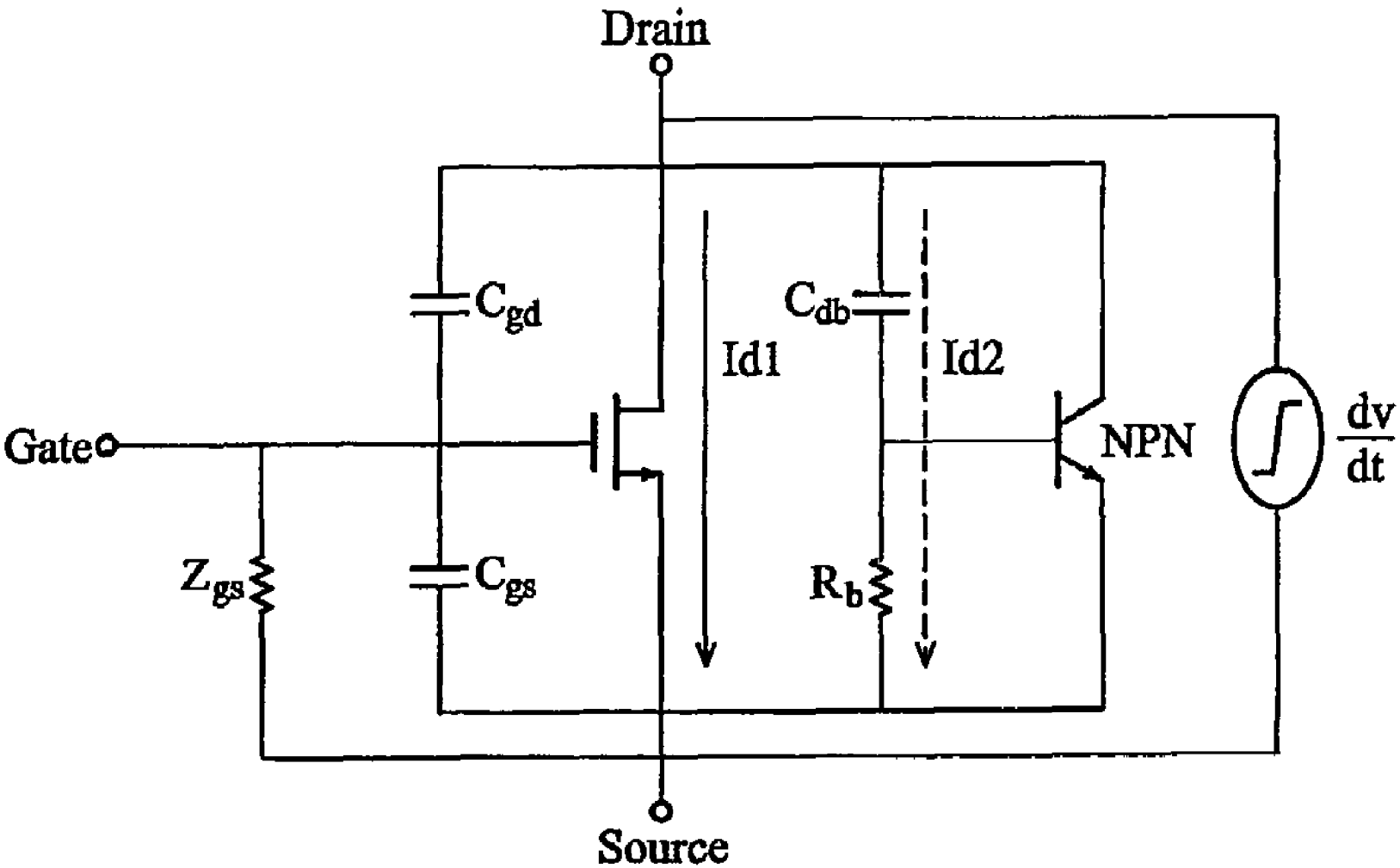
FIG. 6 is an equivalent circuit of a fluid injection device according to an embodiment of the invention.

For example, color and black inkjet heads of a printer commonly use electrical pads AG1, AG2, AG3, $A_1$-$A_8$ and $P_1$-$P_{24}$ to reduce costs. Whether the color or black inkjet head is triggered depends on which CS of the color or black inkjet head is switched on. Therefore, both the color and black inkjet heads can apply a driving voltage of 12V. Each MOSFET 215, such as an NMOS, corresponding to each nozzle can be simplified as an equivalent circuit as shown in FIG. 6. When CS is switched off and the relationship of driving voltage change dependent on the driving time is $$\frac{dV}{dt} = \frac{12\ V}{2us}$$

for $P_1$-$P_{16}$, the total capacitance of the substrate can be expressed as 300 $C_{db}$ in parallel. The resistance of the substrate can be $R_b$. A parasitic NPN bipolar junction transistor (BJT) is triggered when substrate current $I_{d2}$ is great enough that the result of $R_b\times I_{d2}$ is greater than the forward bias of the NPNBJT. Furthermore, if charges accumulated at the junction of the substrate and the MOSFET 215 are not conducted to ground, the trigger time of NPNBJT can be prolonged causing burnout of the fluid injection device.

Figure 7B:
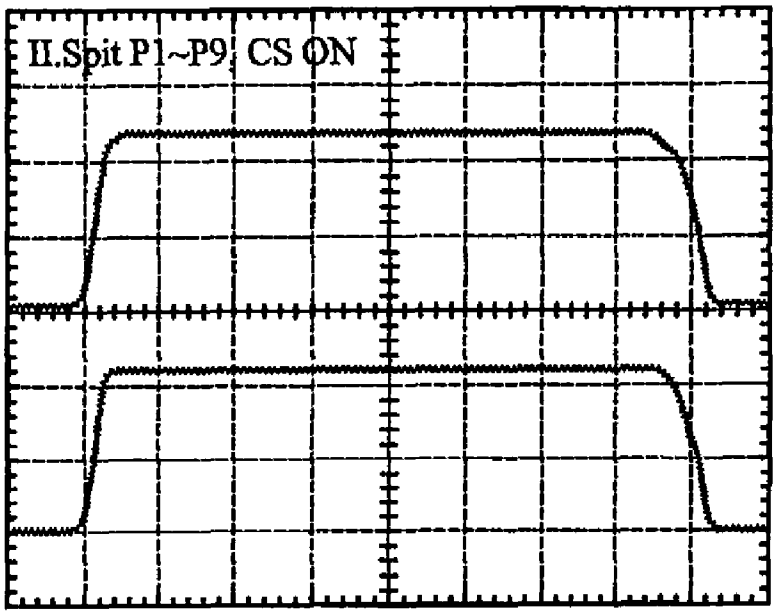
FIGS. 7A-7D are voltage and current waveforms of $P_1$-$P_{16}$ dependent on driving loads under CS on and off states.
Figure 7A:
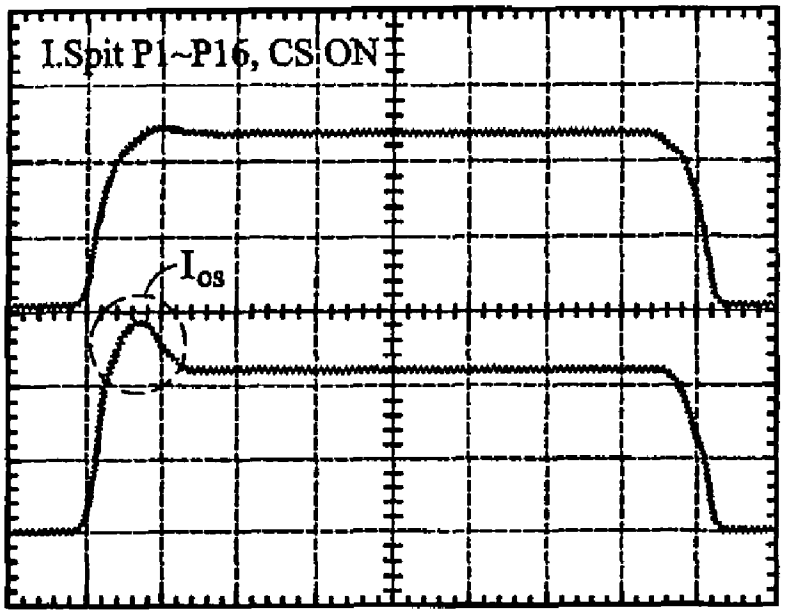

FIGS. 7A-7D are voltage and current waveforms of $P_1$-$P_{16}$ dependent on driving loads under CS on and off states. Referring to FIGS. 7A and 7B, when CS is turn on triggering less than nine P-lines, curves I and II exhibit perfect voltage and current waveforms of $P_1$-$P_9$ without overshoot current $I_{os}$. Optimized injection quality can be achieved when current waveforms without overshoot current $I_{os}$ are provided. If driving more than 9 P-lines simultaneously, overshoot current $I_{os}$ may cause more power consumption. Hot carrier effect may trigger parasitic NPNBJT, reducing lifetime of the injection device.

Figure 7D:
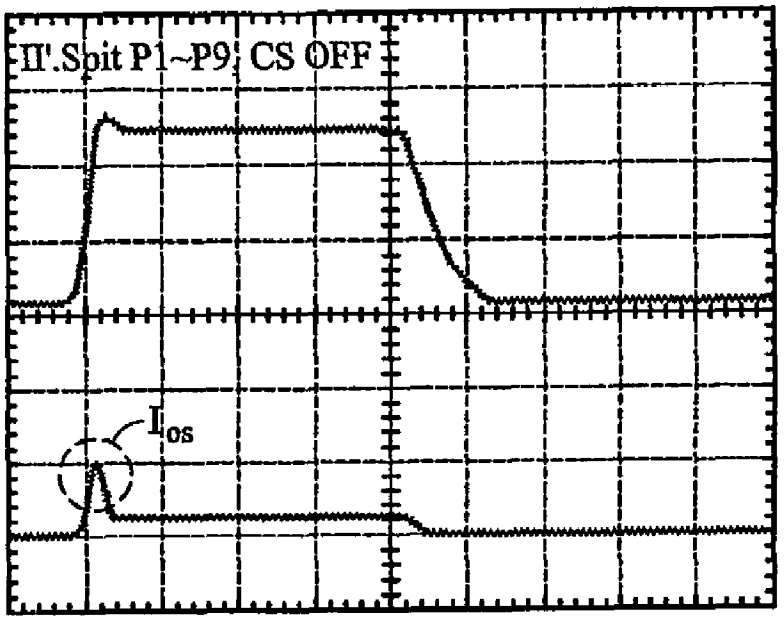
Figure 7C:
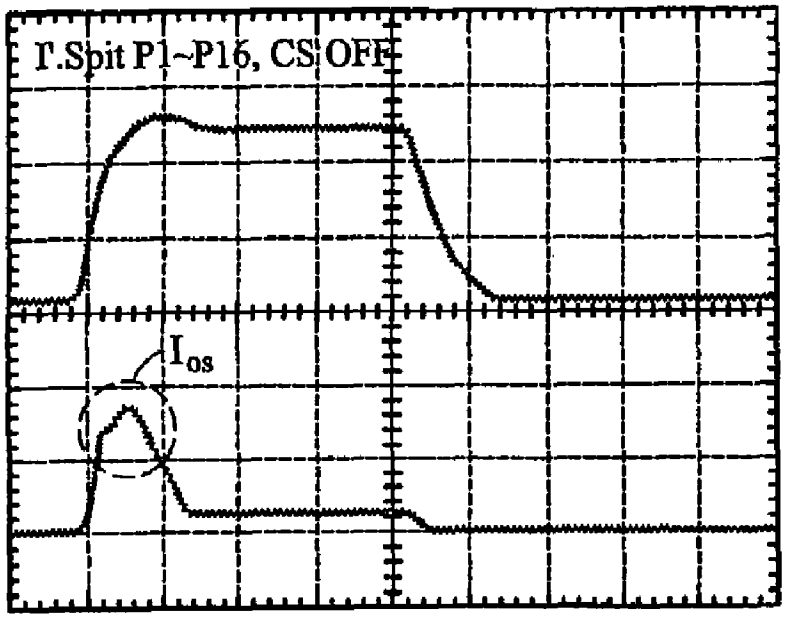

Referring to FIGS. 7C and 7D, when CS is at the off state, curves I' and II' voltage and current waveforms of switching on $P_1$-$P_{16}$ and $P_1$-$P_9$ respectively. Different overshoot currents $I_{os}$ caused by different loading may turn on parasitic NPNBJT.

For example, when driving loads less than 9, i.e., less than 9 P-lines are triggered simultaneously, the driving current waveforms can be square. A drain junction capacitance $C_{JD}$ of each NMOS 215 can be $1.139\times10^{-14}$(F/μm$^2$). FIG. 9 shows the relationship of depletion capacitance of drain junction $C_{JD}$ and the number of driving loads under a dosage concentration of $10^{20}$ atoms/cm$^3$. When reducing the dosage concentration of $10^{20}$ atoms/cm$^3$ by 20%, the driving current waveforms can be square when driving loads more than 10, i.e., when more than 10 P-lines are triggered simultaneously. A depletion capacitance of drain junction $C_{JD}$ of each NMOS 215 can be $1.059\times10^{-14}$(F/μm$^2$) as shown in FIG. 10. When increasing the dosage concentration of $10^{20}$ atoms/cm$^3$ by 20%, the driving current waveforms can be square when driving loads less than 8, i.e., when less than 10 P-lines are triggered simultaneously. A depletion capacitance of drain junction $C_{JD}$ of each NMOS 215 can be $0.991\times10^{14}$(F/μm$^2$) as shown in FIG. 11.

Figure 8:
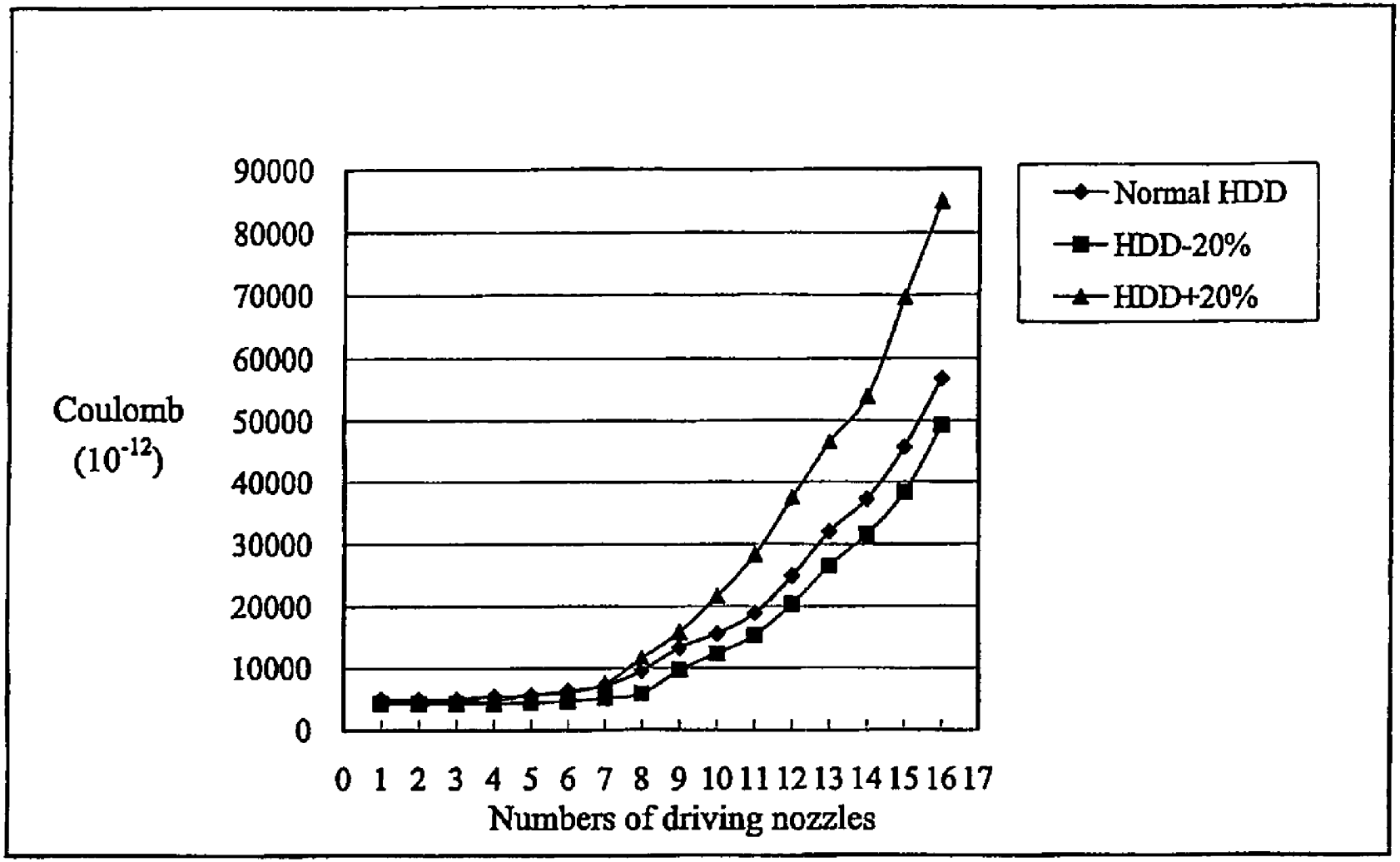
FIG. 8 is a relationship of substrate capacitance dependent on driving loads with dosage concentration variations.

FIG. 8 shows the relationship of substrate capacitance dependent on driving loads with varied dosage concentration. In order to achieve a high printing rate, more P-lines being triggered simultaneously is required. Preferably, 16 P-lines can be triggered simultaneously. When 16 P-lines can be triggered simultaneously, $C_{db}$ of FIG. 6 can be expressed as:

$$C_{db} = C_{JD} \times A_D;$$

$$C_{JD} = \frac{C_{j0}}{\sqrt{1 + \frac{V_{DB}}{\phi_0}}}; \text{ and}$$

$$C_{j0} = \sqrt{\frac{qK_s\varepsilon_0 N_D}{2\phi_0}};$$

where $C_{JD}$ is the depletion capacitance of the drain junction, $A_D$ is the area of the drain junction, $\varnothing_0$ is built-in voltage, q is $1.602\times10^{-19}$C, $\epsilon_0$ is 8.854×10−12 F/m, $K_s$ is relative permittivity of silicon, $N_D$ is dosage concentration.

According to some embodiments of the invention, in order to drive P1-P16 simultaneously under predetermined injection parameters, i.e., with constant driving voltage and heating time, $C_{JD}$ of a MOSFET less than or equal to 1.139×10−14(F/μm$^2$) is required. That is, the concentration of n-type drain doping can be reduced to $10^{20}$-$10^{21}$ atoms/cm$^3$ to ensure driving $P_1$-$P_{16}$ simultaneously without generating overshoot current. Alternatively, $C_{db}$ can also be reduced by shrinking the drain/source area.

While the invention has been described by way of example and in terms of preferred embodiment, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A fluid injection device, comprising:

M sets of fluid injection units, each fluid injection unit comprising N injectors, each injector separately connecting to a metal-oxide-semiconductor (MOS) transistor comprising a drain, a gate, a source, and a base, wherein the drain connects the injector via a signal transmitting circuit; and a controller separately transmitting a signal to the driver, thereby simultaneously driving a selected injector of each of the M sets of fluid injection units;

wherein a non-selected injector of each of the M sets of fluid injection units does not trigger a bipolar junction transistor (BJT), and wherein the drain and the source are HDD regions with a doping concentration in a range of approximately $10^{20}$ to $10^{21}$ atoms/cm$^3$.

2. The device as claimed in claim 1, wherein M is about 1-16.

3. The device as claimed in claim 1, wherein N is about 1-19.

4. The device as claimed in claim 1, wherein the injector and the driver are formed in a single crystalline silicon substrate.

5. The device as claimed in claim 1, wherein the MOS transistor is an N-channel MOS transistor.

6. A fluid injection device, comprising:

M sets of fluid injection units, each fluid injection unit comprising N injectors, each injector separately connecting to a driver; and a controller separately transmitting a signal to the driver, thereby simultaneously driving a selected injector of each of the M sets of fluid injection units;

wherein a non-selected injector of each of the M sets of fluid injection units does not trigger a bipolar junction transistor (BJT), and wherein the injector comprises:

a structural layer disposed on a substrate;

a fluid chamber formed between the substrate and the structural layer;

a channel connecting the fluid chamber;

at least one fluid actuator disposed on the structural layer and opposing the fluid chamber; and a nozzle adjacent to the at least one fluid actuator passing through the structural layer connecting the fluid chamber.

7. The device as claimed in claim 6, wherein the at least one fluid actuator is a thermal bubble generator.

8. The device as claimed in claim 6, wherein the structural layer is a low stress silicon nitride.

9. A fluid injection device, comprising:

M sets of fluid injection units, each fluid injection unit comprising N injectors, each injector separately connecting a MOS transistor comprising a drain, a gate, a source, and a base, wherein the drain connects the injector via a signal transmitting circuit, and wherein the junction capacitance between the drain and the base is equal to or less than $1.139\times10^{-14}$(F/μm$^2$); and a controller separately transmitting a signal to the driver, thereby simultaneously driving the injector of each of the M sets of fluid injection units;

wherein the injector is driven by the driver without triggering a bipolar junction transistor (BJT).

10. The device as claimed in claim 9, wherein M is about 1-16.

11. The device as claimed in claim 9, wherein N is about 1-19.

12. The device as claimed in claim 9, wherein the injector and the driver are formed in a single crystalline silicon substrate.

13. The device as claimed in claim 9, wherein the MOS transistor is an N-channel MOS transistor.

14. The device as claimed in claim 9, wherein the drain and the source are HDD regions with a doping concentration in a range of approximately $10^{20}$ to $10^{21}$ atoms/cm$^3$.

15. The device as claimed in claim 9, wherein the injector comprises:

a structural layer disposed on a substrate;

a fluid chamber formed between the substrate and the structural layer;

a channel connecting the fluid chamber;

at least one fluid actuator disposed on the structural layer and opposing the fluid chamber; and a nozzle adjacent the at least one fluid actuator passing through the structural layer connecting the fluid chamber.

16. The device as claimed in claim 15, wherein the at least one fluid actuator is a thermal bubble generator.

17. The device as claimed in claim 15, wherein the structural layer is a low stress silicon nitride.

* * * * *